US008961148B2

(12) United States Patent
Hunter et al.

(10) Patent No.: US 8,961,148 B2
(45) Date of Patent: Feb. 24, 2015

(54) UNIFIED VARIABLE DISPLACEMENT OIL PUMP AND VACUUM PUMP

(76) Inventors: Douglas G. Hunter, Troy, MI (US); Dennis N. Koenig, Hartland, MI (US)

( * ) Notice: Subject to any disclaimer, the term of this patent is extended or adjusted under 35 U.S.C. 154(b) by 661 days.

(21) Appl. No.: 13/135,949

(22) Filed: Jul. 19, 2011

(65) Prior Publication Data

US 2013/0022485 A1 Jan. 24, 2013

(51) Int. Cl.

| | |
|---|---|
| ***F04B 23/08*** | (2006.01) |
| ***F04B 23/12*** | (2006.01) |
| ***F04C 18/344*** | (2006.01) |
| ***F04C 25/02*** | (2006.01) |
| ***F04C 11/00*** | (2006.01) |
| ***F04C 2/10*** | (2006.01) |
| ***F04C 2/344*** | (2006.01) |
| *F04C 14/22* | (2006.01) |

(52) U.S. Cl.

CPC ..... *F04C 18/3441* (2013.01); *F04C 25/02* (2013.01); *F04C 11/005* (2013.01); *F04C 2/102* (2013.01); *F04C 2/344* (2013.01); *F04C 14/226* (2013.01); *F04C 2240/60* (2013.01)

USPC ..... 417/216; 417/220

(58) Field of Classification Search

CPC ..... F04B 23/04; F04B 23/08; F04B 23/12; F04B 41/06; F04C 11/00; F04C 11/001; F04C 11/003; F04C 11/008

USPC ..... 417/216, 220

See application file for complete search history.

(56) References Cited

U.S. PATENT DOCUMENTS

| | | | | |
|---|---|---|---|---|
| 1,657,905 | A * | 1/1928 | Smith | 417/286 |
| 2,766,693 | A * | 10/1956 | Wells | 417/206 |
| 2,832,403 | A * | 4/1958 | Erikson | 239/61 |
| 2,892,413 | A * | 6/1959 | Erikson | 417/206 |
| 3,037,455 | A * | 6/1962 | Bozimowski et al. | 418/3 |
| 3,178,103 | A | 4/1965 | Schnacke | |
| 3,744,942 | A * | 7/1973 | Mount | 418/76 |

(Continued)

FOREIGN PATENT DOCUMENTS

| | | |
|---|---|---|
| CN | 101876307 A | 11/2010 |
| DE | 102004034925 | 2/2006 |
| DE | 102006029553 | 12/2007 |

(Continued)

OTHER PUBLICATIONS

International Search Report and Written Opinion for Application No. GB1203602.6 Filed Mar. 1, 2012.

*Primary Examiner* — Peter J Bertheaud
(74) *Attorney, Agent, or Firm* — Warn Partners, P.C.

(57) ABSTRACT

A unified variable displacement pump having a housing which includes a fluid pump and a vacuum pump. A portion of the housing is part of the fluid pump, and a portion of the housing is part of the vacuum pump. A shaft extends through the fluid pump and the vacuum pump. A vacuum pump rotor is formed as part of the shaft, and a vane pump rotor is mounted to the shaft such that when the shaft rotates, the vacuum pump rotor and the vane pump rotor rotate, causing the fluid pump to pump fluid and the vacuum pump to generate a vacuum. The vacuum pump and fluid pump are combined into a single component driven by a single shaft.

22 Claims, 8 Drawing Sheets

(56) References Cited

U.S. PATENT DOCUMENTS

| | | | | |
|---|---|---|---|---|
| 4,415,319 | A * | 11/1983 | Masuda et al. | 418/135 |
| 4,497,618 | A * | 2/1985 | Anderson et al. | 418/212 |
| 4,512,728 | A * | 4/1985 | Nakano et al. | 418/3 |
| 6,913,446 | B2 * | 7/2005 | Nissen et al. | 417/53 |
| 2006/0213477 | A1 | 9/2006 | Schulz-Andres et al. | |
| 2009/0169409 | A1 | 7/2009 | Schneider | |
| 2009/0211092 | A1 | 8/2009 | Tanaka et al. | |

FOREIGN PATENT DOCUMENTS

| | | | |
|---|---|---|---|
| GB | 2305218 | A | 4/1997 |
| JP | 2002349465 | A | 12/2002 |
| WO | 2010115695 | A2 | 10/2010 |
| WO | 2012021992 | A1 | 2/2012 |

* cited by examiner

UNIFIED VARIABLE DISPLACEMENT OIL PUMP AND VACUUM PUMP

FIELD OF THE INVENTION

The present invention relates to unified pump which combines an air pump and a liquid pump which are driven by the same shaft.

BACKGROUND OF THE INVENTION

Vacuum pumps are also commonly used for generating a vacuum, which may be used for a variety of different applications, such as drawing air from a cavity or actuating a device, such as a valve.

Typical vacuum pumps include a rotor mounted to a hub driven by a coupled shaft, which extends away from only one side of the rotor. The rotor includes a slot formed as part of the rotor, and a vane slidably extends through the slot. The rotor and vane are located in a cavity formed as part of a housing such that the rotational axis of the rotor is offset from the center of the housing, and the vane is in sliding contact with the inside surface of the outer wall of the housing. The cavity formed as part of the housing is in fluid communication with an inlet passage and an outlet passage. When the rotor and vane rotate, the vane slides within the slot, creating an enclosed volume in the cavity which expands in size, and an enclosed volume in the cavity which contracts in size. The volume which expands in size creates a vacuum, which is used to perform a variety of functions.

However, the rotor only having the hub extend away from one side of the rotor is vulnerable to "tilting" due to the rotor not being supported on both sides, and "flaring" in which the lobes of the rotor adjacent the vane separate under centrifugal forces as the rotor rotates during operation. Accordingly, there exists a need for a vacuum pump which overcomes these issues.

SUMMARY OF THE INVENTION

The present invention is directed to a unified variable displacement pump which includes a vacuum pump and fluid pump combined together into a single unit and driven by the same shaft with an integrated vacuum pump rotor.

In one embodiment, the present invention is a unified variable displacement pump having a housing and a fluid pump and a vacuum pump. A portion of the housing is part of the fluid pump, and a portion of the housing is part of the vacuum pump. A shaft extends through the fluid pump and the vacuum pump, and has a first portion and a second portion. A vacuum pump rotor is formed as part of the shaft such that the first portion extends away from one side of the vacuum pump rotor, and the second portion extends away from the other side of the vacuum pump rotor. The fluid pump includes a vane pump rotor mounted to the second portion of the shaft such that when the shaft rotates, the vacuum pump rotor and the vane pump rotor rotate, causing the fluid pump to pump fluid and the vacuum pump to generate a vacuum.

The present invention combines the vacuum pump and fluid pump into a single component driven by a single shaft. In one embodiment, the unified variable displacement pump is disposed in the crankcase of an engine, where the fluid pump is used to circulate engine oil throughout the engine, and the vacuum pump is used to create a vacuum which may be used for a variety of applications. The vacuum created by the vacuum pump may be used for removing air from a cavity, such as a brake booster reservoir, but it is within the scope of the invention that the vacuum created by the vacuum pump may be used for other applications as well, such as actuating a valve.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
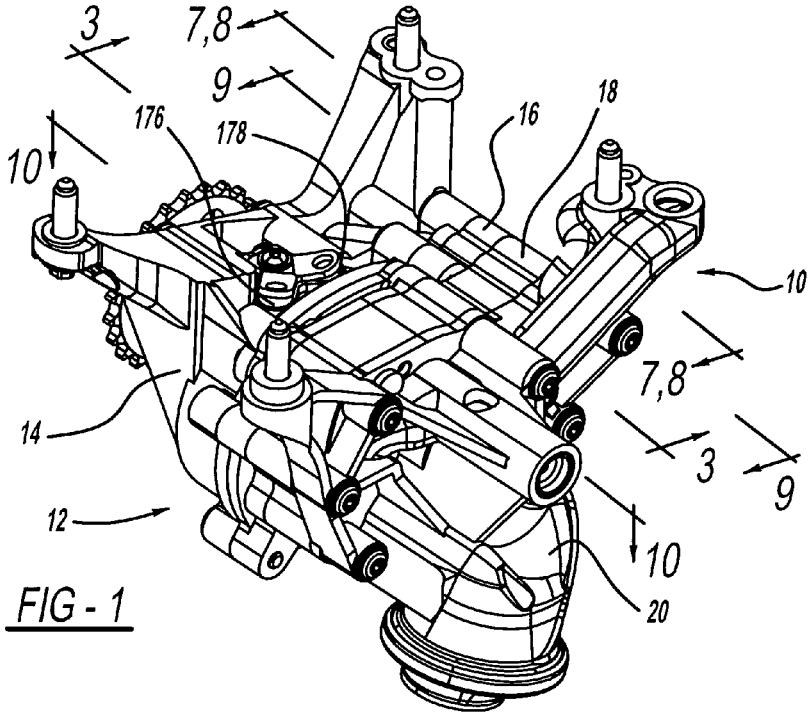
FIG. 1 is a first perspective view of a unified variable displacement oil pump and vacuum pump, according to the present invention.

The following description of the preferred embodiment(s) is merely exemplary in nature and is in no way intended to limit the invention, its application, or uses.

Referring to the Figures generally, a unified variable displacement pump is shown generally at 10. The pump 10 has a casing or housing, shown generally at 12, and more specifically, a vacuum housing 14, and an intermediate housing 16, an inner pump housing 18, and an outer pump housing 20.

Extending through each of the housings 14,16,18,20 is an integrated shaft 22. The shaft 22 has a first portion, generally shown at 24, which extends out of the vacuum housing 14; a sprocket 26 is mounted on the first portion 24, and the sprocket 26 is partially surrounded by a chain 28. The chain 28 is operably connected to and driven by the crankshaft (not shown) of an engine, providing power to the pump 10. The first portion 24 terminates into a first tapered portion 30, and the first tapered portion 30 is connected to a vacuum pump rotor, shown generally at 32. More specifically, the vacuum pump rotor 32 includes a first lobe 31A and a second lobe 31B. The first tapered portion 30 is connected to the lobes 31A,31B. In between the lobes 31A,31B is a slot 34 which extends through the rotor 32, and a vacuum pump vane 36 extends through the slot 34.

Also connected to the lobes 31A,31B of the rotor 32 is a second tapered portion 38, and a second portion, shown generally at 40, of the shaft 22 extends away from the second tapered portion 38. The second portion 40 of the shaft 22 includes a pair of flattened portions 42 which are on opposite sides of the shaft 22 relative to one another, and a reduced diameter portion 44.

The vacuum housing 14 includes a cavity, shown generally at 46, and an aperture 48. When the pump 10 is assembled, the rotor 32 is disposed within the cavity 46 and is adjacent an inner surface 50, and the first tapered portion 30 and the first portion 24 are disposed in the aperture 48. The aperture 48 is of a corresponding shape relative to the shape of the first portion 24 and first tapered portion 30, but provides for a gap or clearance area, generally shown at 52. The gap 52 also accommodates a first bearing 54 disposed on the first portion 24, which supports the shaft 22.

The inner surface 50 of the cavity 46 is substantially perpendicular to a wall portion 60. The wall portion 60 terminates in an outer surface 62 that has a groove 64 which receives a seal 66. When the pump 10 is assembled, pressure is applied to compress the seal 66 a predetermined amount against a first outer surface 68 of the intermediate housing 16. The intermediate housing 16 also includes an aperture 70 which receives the second tapered portion 38, and is of a similar shape relative to the second tapered portion 38. Although the aperture 70 is substantially the same shape as the second tapered portion 38, the aperture 70 is larger relative to the second tapered portion 38 to allow for a gap or clearance area, shown generally at 72.

The second portion 40 of the shaft 22 extends through the inner pump housing 18 and into a recess 74 formed as part of the outer pump housing 20. Also disposed within the recess 74 is a second bearing 76, which surrounds the reduced diameter portion 44 of the shaft 22. The bearings 54,76 allow the shaft 22 to rotate relative to the housing 20.

Figure 2:
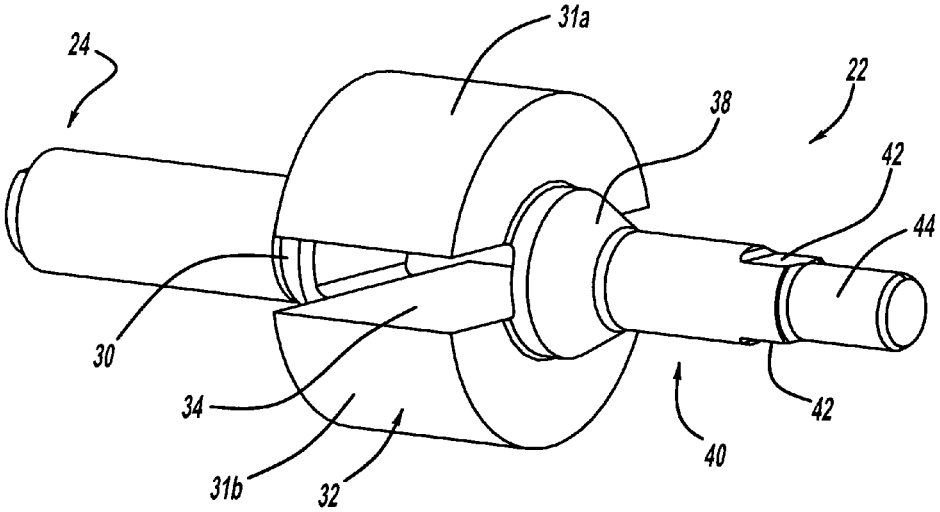
FIG. 2 is a perspective view of an integrated shaft used as part of a unified variable displacement oil pump and vacuum pump, according to the present invention

Mounted on the second portion 40 of the shaft 22 is a vane pump rotor 78, which has an aperture 80 through which the second portion 40 extends such that the vane pump rotor 78 is mounted on the second portion 40 of the shaft 22. The aperture 80 includes a pair of flat surfaces 82 which are of a corresponding shape relative to the flattened portions 42. The vane pump rotor 78 is mounted to the second portion 40 of the shaft 22 such that the flat surfaces 82 are in contact with the flattened portions 42 of the shaft 22, such that the vane pump rotor 78 is driven by the shaft 22 as the shaft 22 rotates, best seen in FIGS. 2-3.

The vane pump rotor 78 is disposed within a cavity, shown generally at 84, formed as part of the inner pump housing 18. The vane pump rotor 78 is also positioned in contact with a second outer surface 86 formed as part of the intermediate housing 16, and the inner pump housing 18 is also adjacent the intermediate housing 16 and in contact with the second outer surface 86. Also disposed within the cavity 84 is an eccentric ring 88, and the eccentric ring 88 surrounds the vane pump rotor 78. The eccentric ring 88 has a first notch 90A which partially receives a pivot pin 92, and the pivot pin 92 is also partially disposed in a second notch 90B formed as part of the inner pump housing 18.

The eccentric ring 88 also has an outer flange 94 which has an upper notch 96A for receiving a seal 96B which contacts an upper inner surface 98 of the cavity 84. The outer flange 94 is in contact with a biasing member or spring 100, and the spring 100 is also in contact with a support surface 102. A t-shaped recess 104A is also formed as part of the inner pump housing 18 which receives an insert, more specifically, a t-shaped insert 104B. The t-shaped insert 104B sets the maximum amount of distance the eccentric ring 88 is allowed to pivot. Different inserts 104B of different sizes may be used to change the maximum amount of distance the eccentric ring 88 is allowed to pivot, depending upon the application and the desired amount of maximum displacement.

The vane pump rotor 78 also includes several slots 106, each of which receives a respective one of a plurality of vanes 108. Each vane 108 is supported by a pair of support rings 110, and the support rings 110 are slidably disposed in recessed portions 134 formed as part of the vane pump rotor 78. The vanes 108 are in sliding contact with an inner surface 114 of the eccentric ring 88 for generating a pumping action.

The outer pump housing 20 includes an intake passage, shown generally at 116, and output passage, shown generally at 118. Both passages 116,118 are in fluid communication with the cavity 84. The outer pump housing 20 also includes a pressure relief valve, shown generally at 120, which is in fluid communication with the output passage 118. More specifically, the intake passage 116 and the output passage 118 are in fluid communication with the part of the cavity 84 surrounded by the inner surface 114 of the eccentric ring 88. The pressure relief valve 120 includes a check ball 122 and a spring 124 disposed in a bore 126 formed as part of the outer pump housing 20.

The housings 18,20, vane pump rotor 78, eccentric ring 88, vanes 108, support ring 110, and other components located in the cavity 84 are part of a fluid pump, shown generally at 128, powered by the shaft 22. When the shaft 22 is driven for rotation by the chain 28, the rotor 78 rotates as well, driving the vanes 108 to pump fluid. The areas in between the vanes 108 function as either expansion areas 130 or compression areas 132, depending upon the position of the vanes 108 and rotor 78. The expansion areas 130 are substantially in fluid communication with the intake passage 116, and the compression areas 132 are substantially in fluid communication with the output passage 118. As the vanes 108 pass over the intake passage 116, the area in between the vanes 108 expands, creating a suction force, which draws fluid into the expansion areas 130. The area in between the vanes 108 then reaches a maximum amount, and then begins to reduce in size as the vanes 108 pass over the output passage 118 (i.e., the compression areas 132). As the area between the vanes 108 gets smaller, the fluid in between the vanes 108 is forced into the output passage 118.

Figure 3:
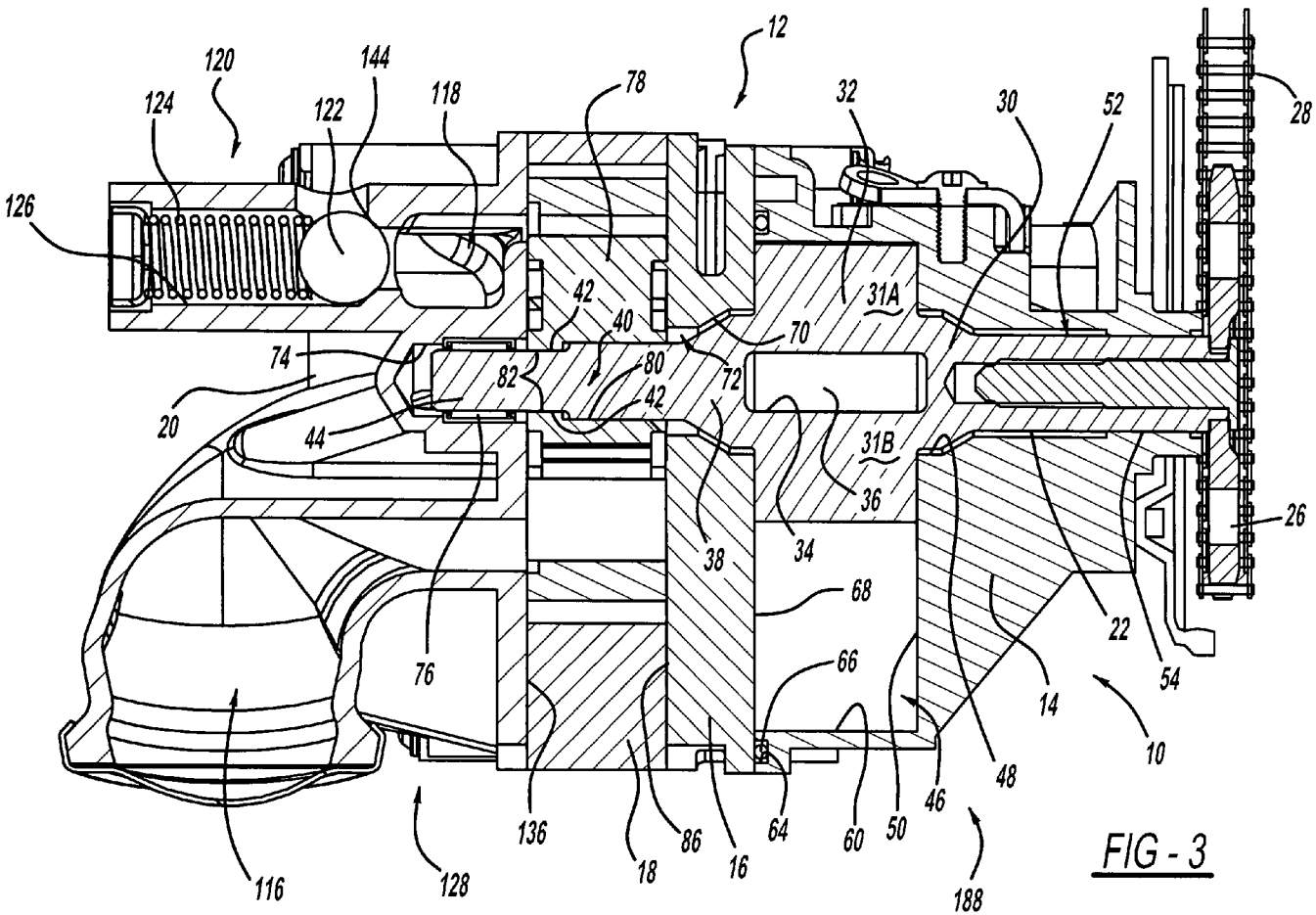
FIG. 3 is an enlarged sectional side view of section 3-3 in FIG. 1.
Figure 4:
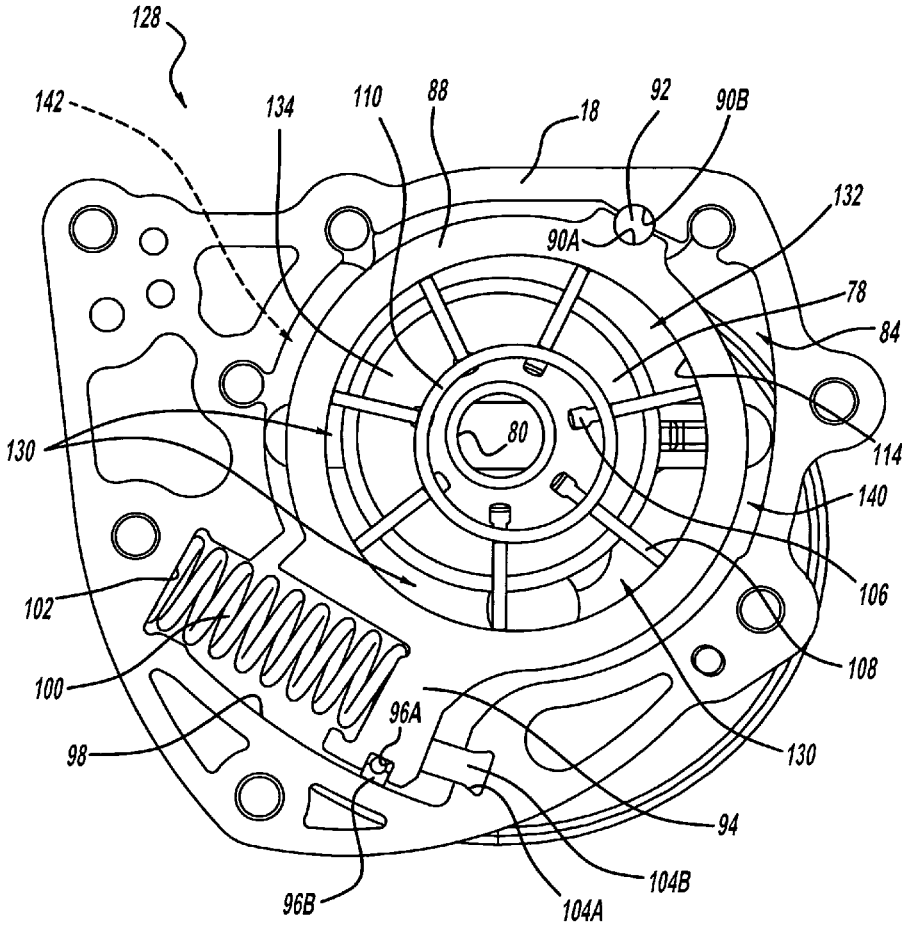
FIG. 4 is a second perspective view into the oil pump stage of a unified variable displacement oil pump and vacuum pump, according to the present invention.

The vanes 108 remain in sliding contact with the inner surface 114 of the eccentric ring 88 because of the support ring 110. It can be seen in FIG. 4 that the center of the support ring 110 is offset from the center of the rotor 78 and shaft 22. However, the support ring 110 is movable within the recessed portion 134 such that the center of the support ring 110 may be in substantial alignment with the center of the shaft 22 and the rotor 78. More specifically, in this embodiment there are two support rings 110 movably disposed in respective recessed portions 134 formed on opposite sides of the rotor 78. The depth of each recessed portion 134 is substantially similar to the width of a corresponding support ring 110, best seen in FIGS. 3 and 10. As shown in FIG. 3, the rotor 78, one of the support rings 110 and vanes 108 are also slidably disposed against the second outer surface 86 of the intermediate housing 16. Furthermore, the rotor 78, the other of the support rings 110, and vanes 108 are slidably disposed against an inner surface 136 of the outer pump housing 20. Having two support rings 110 provides better support for the vanes 108. The support ring 110 functions to allow the vanes 108 to remain in contact with the inner surface 114 of the eccentric ring 88 at all times.

As the eccentric ring 88 pivots about the pivot pin 92, the vanes 108 and support rings 110 move relative to the rotor 78, but the vanes 108 are still allowed to slide in their respective slots 106. This changes the displacement of the fluid pump 128 by changing the maximum and minimum size of the expansion areas 130 and compression areas 132. The displacement is not only controlled by the spring 98, but is also controlled by the amount of fluid pressure in a pressure regulation chamber, or decrease chamber, shown generally at 140.

If the force created by the pressure in the decrease chamber 140 acting on the eccentric ring 88 is greater than the force applied to the eccentric ring 88 by the pressure in the spring 98, the displacement of the pump 128 decreases. If the force created by the pressure in the chamber 140 is less than or equal to the force applied to the eccentric ring 88 by the spring 98, then the pump 128 remains at a constant displacement. If the force created by the pressure in the chamber 140 is less than the force applied to the eccentric ring 88 by the spring 98, then the displacement of the pump 128 increases.

The pump 128 may also have substantially zero displacement and not pump fluid if the eccentric ring 88 is positioned such that the center of the eccentric ring 88 is substantially aligned with the center of the rotor 78, which causes the center of the support rings 110 to be substantially aligned with the center of the rotor 78. When this occurs, the vanes 108 do not move in their respective slots 106 as the rotor 78 rotates, and the expansion areas 130 and compression areas 132 are substantially equal in size to one another, and do not change size as the rotor 78 rotates, and therefore do not pump fluid.

In an alternate embodiment, the pump 128 may also include an increase chamber, shown generally at 142, which acts with the spring 98 to increase the displacement of the pump 128. For example, if the pressure in the increase chamber 142 combined with the force applied to the eccentric ring 88 is greater than the pressure in the decrease chamber 140, the displacement of the pump 128 increases.

As mentioned above, the pump 128 also includes a pressure relief valve 120. Upon certain operating conditions such as a cold start, the if the fluid pressure in the output passage 118 exceeds a predetermined value, the pressure acts on the check ball 122, overcoming the force of the spring 124 applied to the check ball 122, allowing fluid to enter the bore 126 and exit a fluid exhaust port 144 into the crankcase of the engine. This helps to limit the amount of fluid pressure in the output passage 118 to a predetermined maximum value.

The decrease chamber 140 is in fluid communication with a bore (not shown) formed as part of the intermediate housing 16. The bore in the intermediate housing 16 is in fluid communication with an arcuate passage 146 formed as part of the outer surface 62, best seen in FIG. 5-6. The arcuate passage 146 is in fluid communication with a first fluid bore 148 formed as part of the vacuum housing 14, and the first fluid bore 148 is in fluid communication with a second fluid bore 150, also formed as part of the vacuum housing 14. Disposed within the first fluid bore 148 is a return spring 152 and a spool 154 having a reduced diameter portion 156. The control of the displacement of the pump 128 is achieved by controlling the amount of fluid fed through the fluid bores 148,150 the arcuate passage 146, the bore in the intermediate housing 16, and into the decrease chamber 140.

Also formed as part of the vacuum housing 14 is an air inlet passage 158, which is fluid communication with a check valve, shown generally at 160, having a check ball 162 disposed in a bore 164, and a return spring 166. The return spring 166 biases the check ball 162 toward a seat portion 168. The bore 164 is of a larger diameter than the air inlet passage 158, and there is a smaller bore 170 formed as part of the intermediate housing 16, and the smaller bore 170 includes a support surface 172. The return spring 166 is located between the support surface 172 and the check ball 162. The smaller bore 170 is in fluid communication with a transverse bore 174, and the transverse bore 174 is in fluid communication with the cavity 46 of the vacuum housing 14. Also in fluid communication with the cavity 46 of the vacuum housing 14 are two breather bores (not shown) which are in respective fluid communication with a first breather outlet 176 and a second breather outlet 178.

Figure 5:
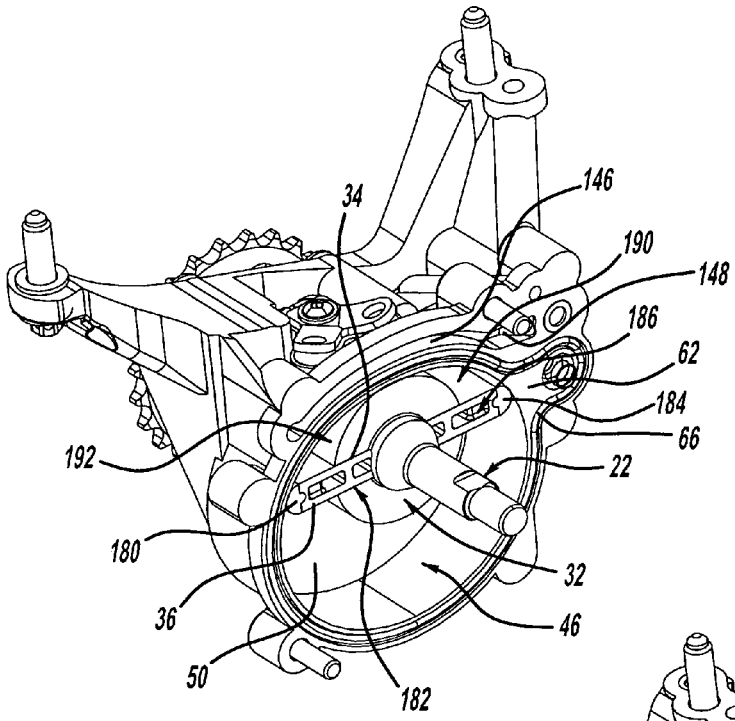
FIG. 5 is a front view into the vacuum pump stage of a unified variable displacement oil pump and vacuum pump, according to the present invention.
Figure 6:
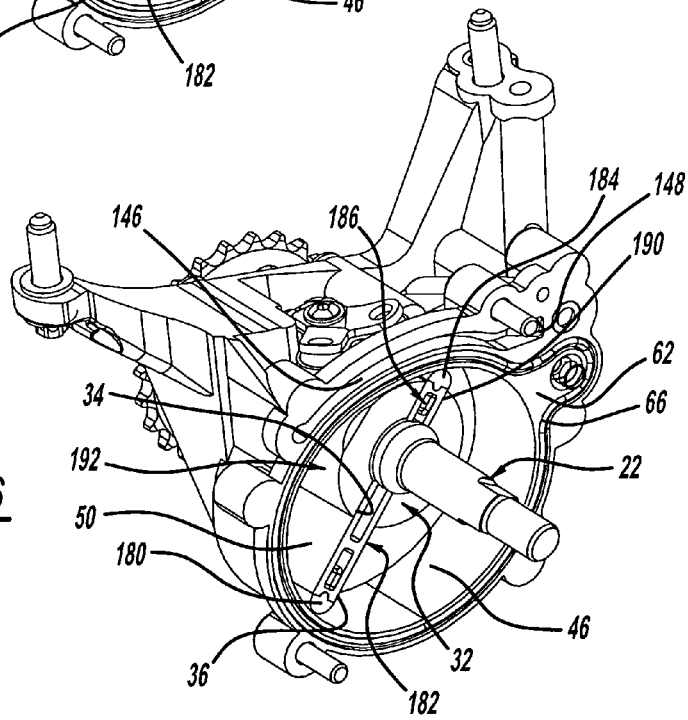
FIG. 6 is an enlarged perspective view of the integrated shaft and vacuum pump vane of a unified variable displacement oil pump and vacuum pump, according to the present invention.
Figure 7:
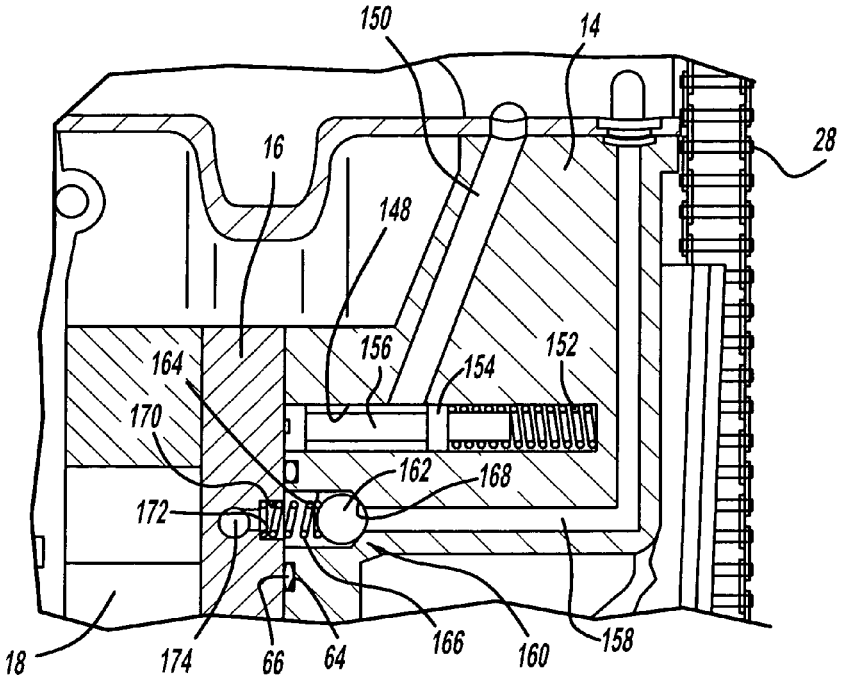
FIG. 7 is a first sectional view taken along lines 7-7 of FIG. 1, according to the present invention.
Figure 8:
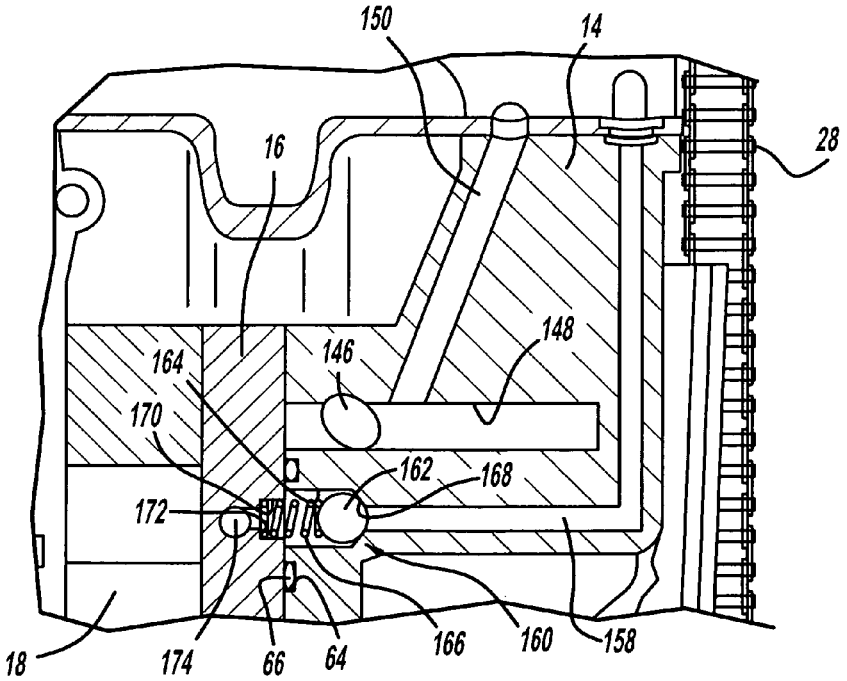
FIG. 8 is a second sectional view taken along lines 8-8 of FIG. 1, with the spool and spring removed, according to the present invention.
Figure 9:
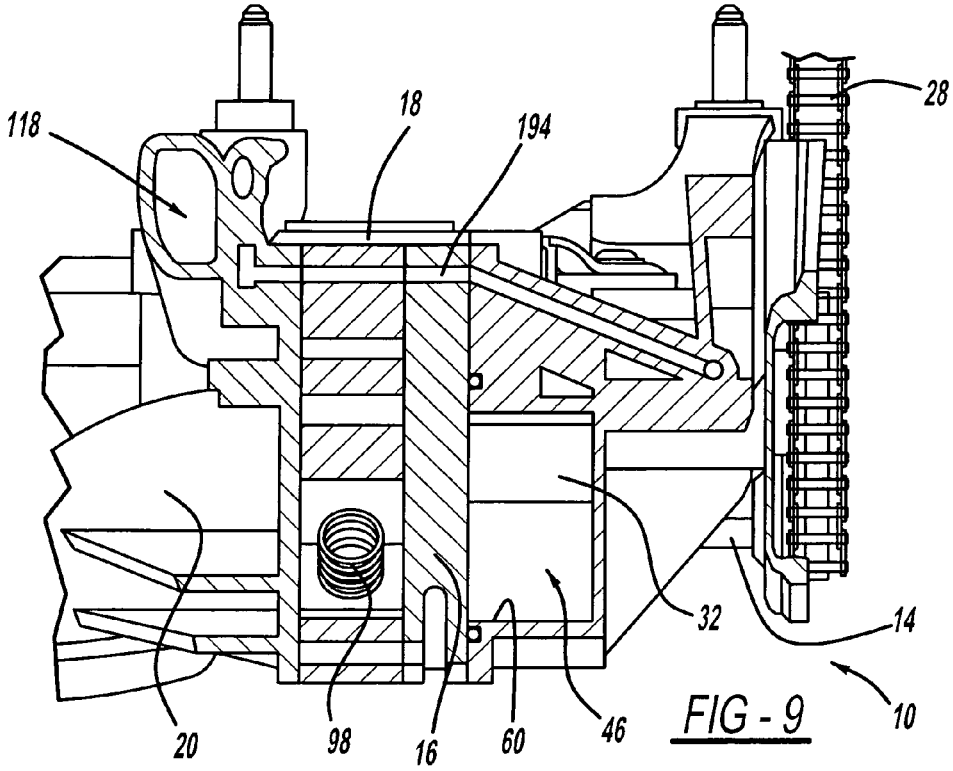
FIG. 9 is a sectional view taken along lines 9-9 of FIG. 1.

As previously discussed, the vacuum pump vane 36 is disposed in slot 34 formed as part of the vacuum pump rotor 32, and the rotor 32 and vane 36 rotate within the cavity 46 of the vacuum housing 14. Referring to FIGS. 5 and 6, the vacuum pump vane 36 includes a first outer tip portion 180 attached to the first end, shown generally at 182, of the vane 36, and a second outer tip portion 184 attached to a second end, shown generally at 186, of the vane 36. The tip portions 180,184 are in sliding contact with the wall portion 60 of the vacuum housing 14. The vacuum housing 14, vacuum pump rotor 32, and vacuum pump vane 36, and other components disposed within the vacuum housing 14 function as a vacuum pump, shown generally at 188, which creates a vacuum which may be used for a variety of applications. In this embodiment, the vacuum generated is used to empty a tank, such as a brake booster reservoir, but it is within the scope of the invention that the vacuum generated by the vacuum pump 188 may be used for other applications, such as actuating a valve.

During operation, the chain 28 is driven by the crankshaft of the engine, which rotates the sprocket 26. The sprocket 26 in turn rotates the shaft 22 and therefore the vacuum pump rotor 32 and the vane pump rotor 78. The vane pump rotor 78, eccentric ring 88, and vanes 108 of the fluid pump 128 are used for pumping fluid, and the displacement of the pump 128 is controlled as described above.

As the vacuum pump rotor 32 rotates, the vane 36 rotates as well. However, it can be seen in FIGS. 3 and 5-6 that the center of the shaft 22 is offset from the center of the cavity 46. This causes the vane 36 to slide within the slot 34 of the vacuum pump rotor 32 as the vacuum pump rotor 32 and the vane 36 rotate. As the rotor 32 and vane 36 rotate, air is drawn into the cavity 46. The vane 36, rotor 32, and wall portion 60 create an air expansion area, shown generally at 190, and an air compression area, shown generally at 192. The air expansion area 190 changes to the air compression area 192, depending upon the position of the rotor 32 and vane 36. The shaft 22, and therefore the rotor 32 and vane 36, rotate clockwise when looking at FIGS. 5-6. As the rotation of the rotor 32 and vane 36 occur, the air expansion area 190 increases in size, creating a vacuum, and drawing air in through the air inlet passage 158, the check valve 160, the bore 164, the smaller bore 170, and the transverse bore 174. The vacuum force created by the air expansion area 190 overcomes the force of the return spring 166 and moves the check ball 162 to allow air to pass through the inlet passage 158 and through the bore 164, while preventing air from flowing back into the inlet passage 158 from the cavity 46.

The air expansion area 190 increases in size as the rotor 32 and vane 36 rotate, as shown in FIG. 6. During the rotation of the rotor 32 and vane 36, the air expansion area 190 changes to the air compression area 192 and begins to reduce in size. The compressed air is forced through the breather bores, and then through either one or both of the first breather outlet 176 and the second breather outlet 178. The breather outlets 176, 178 feed the air into the crankcase (not shown) of the engine.

The unified variable displacement pump 10 of the present invention provides the advantage of having the vane pump or fluid pump 128 and the vacuum pump 188 unified and driven by the same shaft 22. This improves overall packaging and efficiency, reduces part count, and increases robustness by eliminating tipping.

A small portion of the fluid pumped by the fluid pump 128 is used to provide lubrication for the various parts of the unified variable displacement pump 10. More particularly, there is a first fluid delivery conduit 194 in fluid communication with the aperture 48 formed as part of the vacuum housing 14 and the output passage 118. The first fluid delivery conduit 194 is formed as part of the outer pump housing 20, inner pump housing 18, the intermediate housing 16, and the vacuum housing 14. A portion of the pressurized fluid generated by the fluid pump 128 flows through the first fluid delivery conduit 194 and to the bearing 54. Drainage from the bearing 54 passes through the aperture 48 to lubricate the vacuum pump 188. A small portion of the fluid also flows from the aperture 48 toward the cavity 46 and provides provides lubrication between the vacuum pump rotor 32 and the inner surface 50 of the cavity 50, as well as between the vacuum pump rotor 32 and the first outer surface 68 of the intermediate housing 16. The fluid in the cavity 50 also provides lubrication between the tip portions 180,184 of the vacuum pump vane 36 and the wall portion 60.

Figure 10:
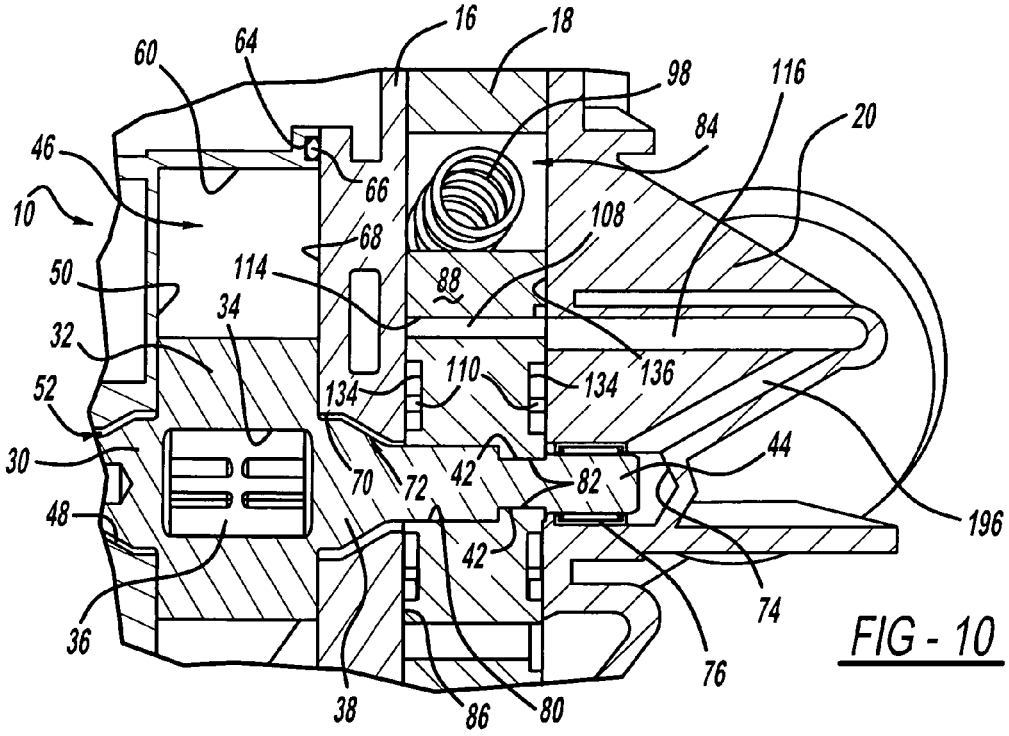
FIG. 10 is a sectional view taken along lines 10-10 of FIG. 1.

Referring to FIG. 10, a second fluid delivery conduit 196 is in fluid communication with the intake passage 116, and is also in fluid communication with the recess 74 in which the second bearing 76 is located. The second fluid delivery conduit 196 facilitates drainage of fluid that flows into around the bearing 76.

Figure 11:
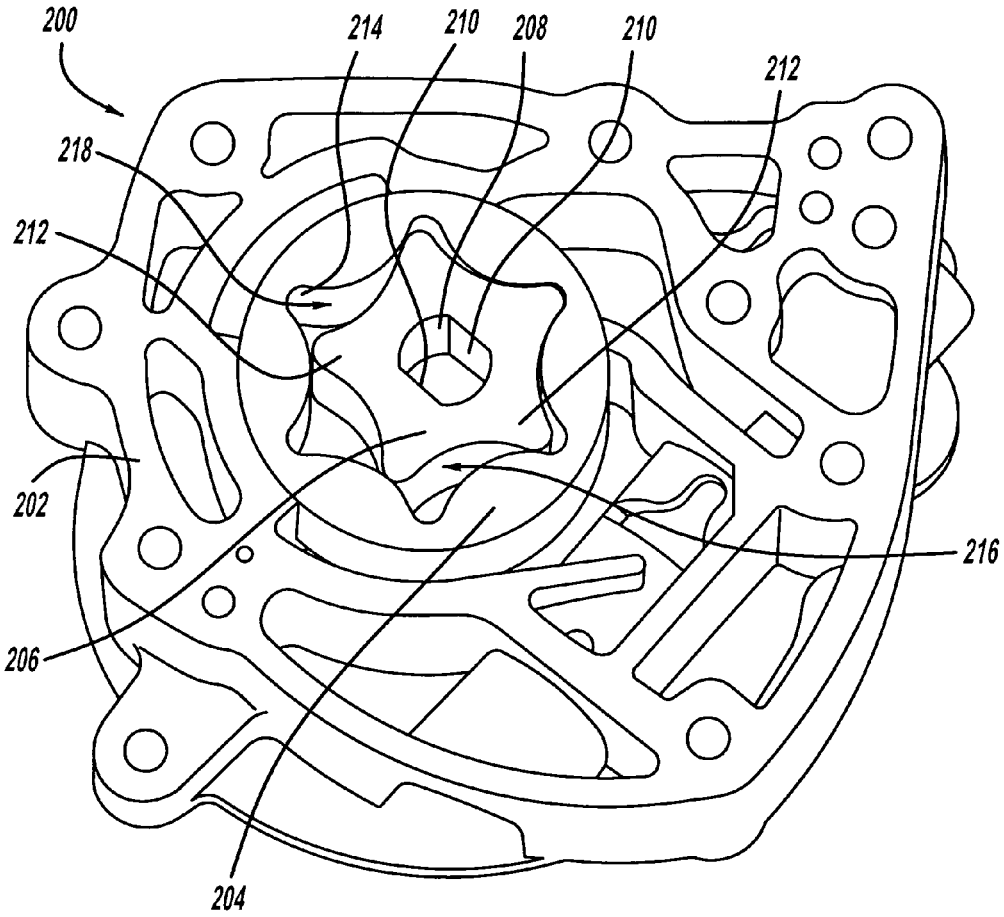
FIG. 11 is a perspective view of an alternate embodiment of a fluid pump used as part of a unified fixed displacement oil pump and vacuum pump, according to the present invention.
Figure 12:
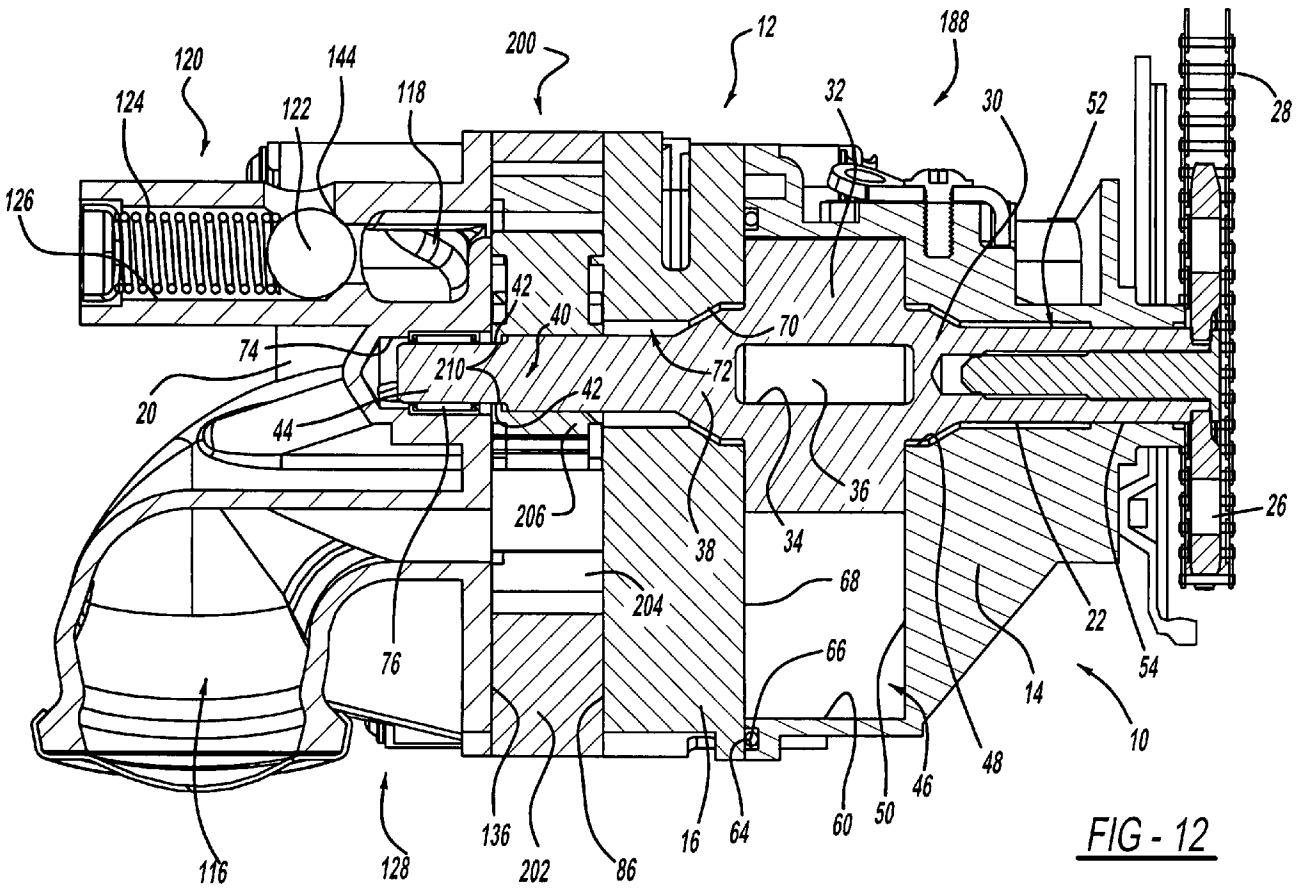
FIG. 12 is a sectional view of an alternate embodiment of a unified variable displacement oil pump and vacuum pump, according to the present invention.

In another alternate embodiment, the fluid pump 128 may be a gerotor pump, shown generally at 200, instead of a vane pump, as previously described. Referring to FIGS. 11 and 12, an alternate embodiment of the unified variable displacement pump 10 is shown, with like numbers referring to like elements. The gerotor pump 200 includes a gerotor pump housing 202, an outer gerotor 204, which circumscribes an inner gerotor 206. The inner gerotor 206 has an aperture 208 which has two flat surfaces 210 which are in contact with the flattened portions 42 of the shaft 22, best seen in FIG. 12. The inner gerotor 206 is driven for rotation by the shaft 22. The inner gerotor 206 also includes a plurality of lobes 212 which selectively engage a corresponding plurality of recesses 214. More particularly, in this embodiment, there are five lobes 212, and six recesses 214.

The gerotor pump housing 202 (and therefore the outer gerotor 204 and the inner gerotor 206), is narrower in width compared to the inner pump housing 18. However, the intermediate housing 16 is wider in this embodiment compared to the intermediate housing 16 shown in FIG. 3 to compensate for the difference in width between the gerotor pump housing 202, and the inner pump housing 18. The shaft 22, outer pump housing 20, and vacuum housing 14 are substantially the same size and shape in this embodiment.

The gerotor pump 200 also includes areas between the lobes 212 and receses 214 which are used for pumping fluid. More specifically, there are expansion areas, shown generally at 216, and fluid compression areas, shown generally at 218, which change depending upon the position of the outer gerotor 204 and inner gerotor 206. The areas 216,218 are in fluid communication with the intake passage 116 and the output passage 118. More specifically, the expansion areas 216 are in fluid communication with the intake passage 116, and the compression areas 218 are in fluid communication with the output passage 118. As each expansion area 216 passes over the intake passage 116, a vacuum is created, drawing fluid into the expansion area 216. Once the expansion area 216 has reached a maximum size, the expansion area 216 then becomes a compression area 218 and reduces in size, pressurizing the fluid and forcing the fluid into the output passage 118.

The gerotor pump 200 is a fixed displacement pump, and the amount of fluid pressure generated by the gerotor pump 200 is based on the speed at which the inner gerotor 206 and outer gerotor 204 are rotated.

The description of the invention is merely exemplary in nature and, thus, variations that do not depart from the essence of the invention are intended to be within the scope of the invention. Such variations are not to be regarded as a departure from the spirit and scope of the invention.

What is claimed is:

1. A unified variable displacement pump, comprising:

a housing;

a fluid pump, a portion of said housing being part of said fluid pump;

a vacuum pump, a portion of said housing being part of said vacuum pump;

an integrated shaft extending through said fluid pump and said vacuum pump, said integrated shaft having a first portion and a second portion;

a vacuum pump rotor formed monolithically with said integrated shaft and connected to said first portion and said second portion of said integrated shaft, said first portion extending away from a first side of said vacuum pump rotor, and said second portion extending away from a second side of said vacuum pump rotor;

a first lobe formed as part of said vacuum pump rotor;

a second lobe formed as part of said vacuum pump rotor in proximity to said first lobe such that first portion of said integrated shaft is connected to said first lobe and said second lobe, and said second portion of said integrated shaft is connected to said first lobe and said second lobe;

a fluid pump rotor mounted to said second portion of said integrated shaft such that when said integrated shaft rotates, said vacuum pump rotor and said fluid pump rotor rotate, causing said fluid pump to pump fluid and said vacuum pump to generate a vacuum;

a single slot extending through said vacuum pump rotor; and a single vacuum pump vane slidably disposed within said slot, said vacuum pump vane extending entirely through said vacuum pump rotor, thereby crossing a longitudinal axis of said integrated shaft.

2. The unified variable displacement pump of claim 1, said vacuum pump further comprising:

a vacuum housing having a cavity, said integrated shaft at least partially disposed within said vacuum housing such that said vacuum pump rotor is at least partially disposed in said cavity, said vacuum housing being part of said housing; and a wall portion formed as part of said cavity, said vacuum pump vane in sliding contact with said wall portion formed as part of said cavity such that as said vacuum pump rotor and said vacuum pump vane rotate, a vacuum is created, drawing air into one portion of said cavity and forcing air out of another portion of said cavity.

3. The unified variable displacement pump of claim 2, said vacuum pump further comprising:

a first tapered portion formed as part of said first portion of said integrated shaft, said first tapered portion connected to said first lobe and said second lobe; and a second tapered portion formed as part of said second portion of said integrated shaft, said second tapered portion connected to said first lobe and said second lobe;

wherein said vacuum pump vane is disposed between said first tapered portion and said second tapered portion when said vacuum pump vane is disposed in said slot.

4. The unified variable displacement pump of claim 2, said vacuum pump further comprising:

an air inlet passage formed as part of vacuum housing such that said air inlet passage is in fluid communication with said cavity formed as part of said vacuum housing; and at least one breather outlet formed as part of said vacuum housing such that said at least one breather outlet is in fluid communication with said cavity formed as part of said vacuum housing;

wherein as said vacuum pump rotor and said vacuum pump vane rotate, air is drawn into said cavity formed as part of said vacuum housing from said air inlet passage and forced out of said cavity formed as part of said vacuum housing through said at least one breather outlet.

5. The unified variable displacement pump of claim 4, further comprising:

at least one air expansion area formed by said vacuum pump vane, said vacuum pump rotor, and at least a portion of said cavity formed as part of said vacuum housing in fluid communication with said air inlet passage; and at least one air compression area formed by said vacuum pump vane, said vacuum pump rotor, and at least a portion of said cavity formed as part of said vacuum housing, said at least one air compression area in fluid communication with said at least one breather outlet;

wherein as said vacuum pump rotor and said vacuum pump vane rotate, said vacuum pump vane slides in said slot, causing said at least one air expansion area to increase in size, drawing air into said cavity formed as part of said vacuum housing from said air inlet passage, and causing said at least one air compression area to decrease in size, and force air from said cavity formed as part of said vacuum housing out of said at least one breather outlet.

6. The unified variable displacement pump of claim 2, further comprising:

a first bearing disposed in an aperture formed as part of said vacuum housing; and a first fluid delivery conduit formed as part of said housing, said first fluid delivery conduit being in fluid communication with an output passage such that a portion of pressurized fluid in said output passage flows through said first fluid delivery conduit to provide lubrication to said first bearing.

7. The unified variable displacement pump of claim 1, said fluid pump further comprising:

an outer pump housing being part of said housing;

an inner pump housing adjacent said outer pump housing, said inner pump housing being part of said housing;

a cavity formed as part of said inner pump housing, said fluid pump rotor disposed in said cavity formed as part of said inner pump housing;

an eccentric ring located in said cavity formed as part of said inner pump housing such that said eccentric ring surrounds said fluid pump rotor;

an intake passage formed as part of said outer pump housing and in fluid communication with said cavity; and an output passage formed as part of said outer pump housing and in fluid communication with said cavity;

wherein said fluid pump rotor draws fluid into said cavity from said intake passage and forces fluid out of said cavity into said output passage as said fluid pump rotor rotates, and the amount of fluid pumped by said fluid pump rotor changes as the position of said eccentric ring changes.

8. The unified variable displacement pump of claim 7, further comprising:

a plurality of slots formed in said fluid pump rotor; and a plurality of vanes in sliding contact with an inner surface formed as part of said eccentric ring, each one of said plurality of vanes slidably disposed in a respective one of said plurality of slots;

wherein said plurality of vanes slide into and out of said plurality of slots to draw fluid into said cavity formed as part of said inner pump housing from said intake passage, and force fluid out of said cavity formed as part of said inner pump housing into said output passage as said fluid pump rotor and said integrated shaft rotate.

9. The unified variable displacement pump of claim 8, further comprising:

at least one expansion area in fluid communication with said intake passage, said at least one expansion area formed by at least two of said plurality of vanes, a portion of said fluid pump rotor, and said eccentric ring; and at least one compression area in fluid communication with said output passage, said at least one compression area formed by at least two of said plurality of vanes, a portion of said fluid pump rotor, and said eccentric ring;

wherein as said integrated shaft and said fluid pump rotor rotate, said at least one expansion area increases in size, drawing fluid into said at least one expansion area from said intake passage, and said at least one compression area reduces in size, forcing fluid into said output passage.

10. The unified variable displacement pump of claim 6, further comprising:

a second bearing disposed in a recess formed as part of said outer pump housing; and a second fluid delivery conduit formed as part of said outer pump housing, said second fluid delivery conduit in fluid communication with said output passage such that a portion of pressurized fluid in said output passage flows through said second fluid delivery conduit to provide lubrication to said second bearing.

11. A unified variable displacement pump, comprising:

a housing;

a fluid pump, a portion of said housing being part of said fluid pump;

a vacuum pump, a portion of said housing being part of said vacuum pump;

an integrated shaft having a first portion and a second portion, said first portion of said shaft extending into said vacuum pump, and said second portion of said integrated shaft extending into said fluid pump;

a vacuum pump rotor formed monolithically with said integrated shaft and disposed within said housing and used as part of said vacuum pump;

a first lobe formed as part of said vacuum pump rotor;

a second lobe formed as part of said vacuum pump rotor such that said first portion of said integrated shaft is connected to and extends away from said first lobe and said second lobe, and said second portion of said integrated shaft is connected to and extends away from said first lobe and said second lobe;

a vane pump rotor mounted on said second portion of said integrated shaft and located in said housing such that said vane pump rotor is a part of said fluid pump;

a first bearing disposed within said housing and mounted to said first portion of said integrated shaft;

a second bearing disposed within said housing and mounted to said second portion of said integrated shaft; wherein said first bearing and said second bearing support said integrated shaft for rotation within said housing such that as said integrated shaft rotates, said vacuum pump rotor rotates to cause said vacuum pump to generate a vacuum, and said vane pump rotor rotates to cause said fluid pump to pump fluid;

a single slot formed through said vacuum pump rotor between said first lobe and said second lobe; and a single vacuum pump vane slidably disposed within said slot, said vacuum pump vane extending entirely through said vacuum pump rotor, thereby crossing a longitudinal axis of said integrated shaft.

12. The unified variable displacement pump of claim 11, said vacuum pump further comprising:

a vacuum housing, said vacuum housing being part of said housing;

a cavity having a wall portion, said cavity formed as part of said vacuum housing, said vacuum pump rotor disposed in said cavity formed as part of said vacuum housing;

a first tapered portion formed as part of said first portion of said integrated shaft and connected to said first lobe and said second lobe such that said first tapered portion is adjacent said slot;

a second tapered portion formed as part of said second portion of said integrated shaft and connected to said first lobe and said second lobe such that said second tapered portion is adjacent said slot; and wherein said vacuum pump vane is in sliding contact with said wall portion and slides in said slot formed as part of said vacuum pump rotor to draw air into said cavity formed as part of said vacuum housing and create said vacuum as said integrated shaft rotates said vacuum pump rotor and said vacuum pump vane.

13. The unified variable displacement pump of claim 12, said vacuum pump further comprising:

an air inlet passage formed as part of said vacuum housing, said air inlet passage in fluid communication with said cavity formed as part of said vacuum housing;

at least one breather outlet formed as part of said vacuum housing, said at least one breather outlet in fluid communication with said cavity formed as part of said vacuum housing;

at least one air expansion area formed by said vacuum pump vane, said vacuum pump rotor, and at least a portion of said cavity formed as part of said vacuum housing, said at least one air expansion area in fluid communication with said air inlet passage; and at least one air compression area formed by said vacuum pump vane, said vacuum pump rotor, and at least a portion of said cavity formed as part of said vacuum housing, said at least one air compression area in fluid communication with said at least one breather outlet;

wherein as said vacuum pump rotor and said vacuum pump vane rotate, said vacuum pump vane slides in said slot, causing said at least one air expansion area to increase in size, drawing air into said cavity formed as part of said vacuum housing from said air inlet passage, and causing said at least one air compression area to decrease in size, and force air from said cavity formed as part of said vacuum housing out of said at least one breather outlet.

14. A unified variable displacement pump, comprising:

a housing;

a fluid pump, a portion of said housing being part of said fluid pump;

a vacuum pump, a portion of said housing being part of said vacuum pump;

an integrated shaft having a first portion and a second portion, said first portion of said shaft extending into said vacuum pump, and said second portion of said integrated shaft extending into said fluid pump;

a vacuum pump rotor formed as part of said integrated shaft and disposed within said housing and used as part of said vacuum pump;

a first lobe formed as part of said vacuum pump rotor;

a second lobe formed as part of said vacuum pump rotor such that said first portion of said integrated shaft is connected to and extends away from said first lobe and said second lobe, and said second portion of said integrated shaft is connected to and extends away from said first lobe and said second lobe;

a vane pump rotor mounted on said second portion of said integrated shaft and located in said housing such that said vane pump rotor is a part of said fluid pump;

a first bearing disposed within said housing and mounted to said first portion of said integrated shaft;

a second bearing disposed within said housing and mounted to said second portion of said integrated shaft;

wherein said first bearing and said second bearing support said integrated shaft for rotation within said housing such that as said integrated shaft rotates, said vacuum pump rotor rotates to cause said vacuum pump to generate a vacuum, and said vane pump rotor rotates to cause said fluid pump to pump fluid;

a vacuum housing, said vacuum housing being part of said housing;

a cavity having a wall portion, said cavity formed as part of said vacuum housing, said vacuum pump rotor disposed in said cavity formed as part of said vacuum housing;

a slot formed as part of said vacuum pump rotor in between said first lobe and said second lobe;

a first tapered portion formed as part of said first portion of said integrated shaft and connected to said first lobe and said second lobe such that said first tapered portion is adjacent said slot;

a second tapered portion formed as part of said second portion of said integrated shaft and connected to said first lobe and said second lobe such that said second tapered portion is adjacent said slot;

a vacuum pump vane slidably disposed within said slot formed as part of said vacuum pump rotor such that said vacuum pump vane is in sliding contact with said wall portion;

wherein said vacuum pump vane slides in said slot formed as part of said vacuum pump rotor to draw air into said cavity formed as part of said vacuum housing and create said vacuum as said integrated shaft rotates said vacuum pump rotor and said vacuum pump vane;

an aperture formed as part of said vacuum housing, said first bearing disposed within said aperture formed as part of said vacuum housing; and a first fluid delivery conduit formed as part of said housing, said first fluid delivery conduit is in fluid communication with said aperture formed as part of said vacuum housing;

wherein said first fluid delivery conduit is in fluid communication said fluid pump such that a portion of pressurized fluid generated by said fluid pump flows through said first fluid delivery conduit to provide lubrication to said first bearing.

15. The unified variable displacement pump of claim 11, fluid pump further comprising:

an inner pump housing, said inner pump housing being part of said housing;

a cavity formed as part of said inner pump housing, said vane pump rotor disposed within said cavity formed as part of said inner pump housing;

at least one slot formed as part of said vane pump rotor;

an eccentric ring pivotally located in said cavity formed as part of said inner pump housing such that said eccentric ring surrounds said vane pump rotor; and at least one vane slidably disposed in said slot formed as part of said vane pump rotor such that said at least one vane is slidably in contact with an inner surface formed as part of said eccentric ring;

wherein as said vane pump rotor and said integrated shaft rotate, said vane pump rotor rotates said at least one vane to cause said fluid pump to pump fluid, and as said eccentric ring is pivoted relative to said inner pump housing, the displacement of said fluid pump changes.

16. The unified variable displacement pump of claim 15, fluid pump further comprising:

an outer pump housing connected to an adjacent said inner pump housing, said outer pump housing being part of said housing;

an intake passage formed as part of said outer pump housing, said intake passage in fluid communication with said cavity formed as part of said inner pump housing;

an output passage formed as part of said outer pump housing, said output passage in fluid communication with said cavity formed as part of said inner pump housing;

at least one expansion area in fluid communication with said intake passage, said at least one expansion area formed by at least two of said plurality of vanes, a portion of said vane pump rotor, and said eccentric ring; and at least one compression area in fluid communication with said output passage, said at least one compression area formed by at least two of said plurality of vanes, a portion of said vane pump rotor, and said eccentric ring;

wherein as said integrated shaft and said vane pump rotor rotate, said at least one expansion area increases in size, drawing fluid into said at least one expansion area from said intake passage, and said at least one compression area reduces in size, forcing fluid into said output passage.

17. A unified variable displacement pump, comprising:

a housing;

a fluid pump, a portion of said housing being part of said fluid pump;

a vacuum pump, a portion of said housing being part of said vacuum pump;

an integrated shaft having a first portion and a second portion, said first portion of said shaft extending into said vacuum pump, and said second portion of said integrated shaft extending into said fluid pump;

a vacuum pump rotor formed as part of said integrated shaft and disposed within said housing and used as part of said vacuum pump;

a first lobe formed as part of said vacuum pump rotor;

a second lobe formed as part of said vacuum pump rotor such that said first portion of said integrated shaft is connected to and extends away from said first lobe and said second lobe, and said second portion of said integrated shaft is connected to and extends away from said first lobe and said second lobe;

a vane pump rotor mounted on said second portion of said integrated shaft and located in said housing such that said vane pump rotor is a part of said fluid pump;

a first bearing disposed within said housing and mounted to said first portion of said integrated shaft;

a second bearing disposed within said housing and mounted to said second portion of said integrated shaft;

wherein said first bearing and said second bearing support said integrated shaft for rotation within said housing such that as said integrated shaft rotates, said vacuum pump rotor rotates to cause said vacuum pump to generate a vacuum, and said vane pump rotor rotates to cause said fluid pump to pump fluid;

an inner pump housing, said inner pump housing being part of said housing;

a cavity formed as part of said inner pump housing, said vane pump rotor disposed within said cavity formed as part of said inner pump housing;

at least one slot formed as part of said vane pump rotor;

an eccentric ring pivotally located in said cavity formed as part of said inner pump housing such that said eccentric ring surrounds said vane pump rotor;

at least one vane slidably disposed in said slot formed as part of said vane pump rotor such that said at least one vane is slidably in contact with an inner surface formed as part of said eccentric ring;

wherein as said vane pump rotor and said integrated shaft rotate, said vane pump rotor rotates said at least one vane to cause said fluid pump to pump fluid, and as said eccentric ring is pivoted relative to said inner pump housing, the displacement of said fluid pump changes;

an outer pump housing connected to an adjacent said inner pump housing, said outer pump housing being part of said housing;

an intake passage formed as part of said outer pump housing, said intake passage in fluid communication with said cavity formed as part of said inner pump housing;

an output passage formed as part of said outer pump housing, said output passage in fluid communication with said cavity formed as part of said inner pump housing;

at least one expansion area in fluid communication with said intake passage, said at least one expansion area formed by at least two of said plurality of vanes, a portion of said vane pump rotor, and said eccentric ring;

at least one compression area in fluid communication with said output passage, said at least one compression area formed by at least two of said plurality of vanes, a portion of said vane pump rotor, and said eccentric ring;

wherein as said integrated shaft and said vane pump rotor rotate, said at least one expansion area increases in size, drawing fluid into said at least one expansion area from said intake passage, and said at least one compression area reduces in size, forcing fluid into said output passage;

a recess formed as part of said outer pump housing, said second bearing mounted to said second portion of said integrated shaft such that said second bearing is disposed in said recess formed as part of said outer pump housing: and a second fluid delivery conduit formed as part of said outer pump housing such that said second fluid delivery conduit is in fluid communication with said recess and said output passage such that a portion of fluid in said output passage flows through said second fluid delivery conduit into said recess to provide lubrication to said second bearing.

18. A unified variable displacement pump, comprising:

a vacuum housing;

an intermediate housing connected to and adjacent said vacuum housing;

an inner pump housing connected to and adjacent said intermediate housing such that said intermediate housing is between said vacuum housing and said inner pump housing;

an outer pump housing connected to and adjacent said inner pump housing such that said inner pump housing is between said outer pump housing and said intermediate housing;

an integrated shaft extending through said vacuum housing, said intermediate housing, said inner pump housing, and said outer pump housing, a first portion of said shaft extending into said vacuum housing, and a second portion of said shaft extending through said intermediate housing and said inner pump housing and into said outer pump housing;

a vacuum pump rotor disposed in said vacuum housing, said vacuum pump rotor formed monolithically with said integrated shaft such that said first portion extends away from a first side of said vacuum pump rotor into said vacuum housing, and said second portion extends away from a second side of said vacuum pump rotor through said intermediate housing and said inner pump housing, and extends into said outer pump housing;

a first lobe formed as part of said vacuum pump rotor;

a second lobe formed as part of said vacuum pump rotor;

a first tapered portion formed as part of said first portion of said integrated shaft such that said first tapered portion is connected to said first lobe and said second lobe;

a second tapered portion formed as part of said second portion of said integrated shaft such that said second tapered portion is connected to said first lobe and said second lobe;

a vane pump rotor mounted to said integrated shaft and disposed in said inner pump housing;

wherein as said integrated shaft rotates, said vacuum pump rotor and said vane pump rotor rotate, causing said vane pump rotor to pump fluid and said vacuum pump rotor to create a vacuum;

a single slot extending through said vacuum pump rotor between said first lobe and said second lobe; and a single vacuum pump vane slidably disposed within said slot, said vacuum pump vane extending entirely through said vacuum pump rotor, thereby crossing a longitudinal axis of said integrated shaft.

19. The unified variable displacement pump of claim 18, further comprising:

a cavity having a wall portion, said cavity formed as part of said vacuum housing, said vacuum pump rotor disposed in said cavity;

wherein said vacuum pump vane has a first portion and a second portion and said first portion of said vacuum pump vane and said second portion of said vacuum pump vane are in sliding contact with said wall portion;

an air inlet passage formed as part of said vacuum housing, said air inlet passage in fluid communication with said cavity formed as part of said vacuum housing;

at least one breather outlet formed as part of said vacuum housing, said at least one breather outlet in fluid communication with said cavity formed as part of said vacuum housing;

at least one air expansion area formed by said vacuum pump vane, said vacuum pump rotor, and at least a portion of said cavity formed as part of said vacuum housing; and at least one air compression area formed by said vacuum pump vane, said vacuum pump rotor, and at least a portion of said cavity formed as part of said vacuum housing;

wherein as said vacuum pump rotor and said vacuum pump vane rotate, said vacuum pump vane slides in said slot, causing said at least one air expansion area to increase in size, drawing air into said cavity formed as part of said vacuum housing from said air inlet passage, and causing said at least one air compression area to decrease in size, and force air from said cavity formed as part of said vacuum housing out of said at least one breather outlet.

20. The unified variable displacement pump of claim 18, further comprising:

a cavity formed as part of said inner pump housing, said vane pump rotor disposed within said cavity formed as part of said inner pump housing;

an eccentric ring pivotally disposed within said cavity formed as part of said inner pump housing such that said eccentric ring surrounds said vane pump rotor;

a plurality of slots formed as part of said vane pump rotor;

a plurality of vanes in sliding contact with an inner surface of said eccentric ring, each one of said plurality of vanes slidably disposed within a respective one of said plurality of slots;

an intake passage formed as part of said outer pump housing and in fluid communication with said cavity formed as part of said inner pump housing; and an output passage formed as part of said outer pump housing and in fluid communication with said cavity formed as part of said inner pump housing;

at least one expansion area in fluid communication with said intake passage, said at least one expansion area formed by at least two of said plurality of vanes, a portion of said vane pump rotor, and said eccentric ring; and at least one compression area in fluid communication with said output passage, said at least one compression area formed by at least two of said plurality of vanes, a portion of said vane pump rotor, and said eccentric ring;

wherein as said integrated shaft and said vane pump rotor rotate, said at least one expansion area increases in size, drawing fluid into said at least one expansion area from said intake passage, and said at least one compression area reduces in size, forcing fluid into said output passage.

21. A unified variable displacement pump, comprising:

a housing;

a fluid pump, a portion of said housing being part of said fluid pump;

a vacuum pump, a portion of said housing being part of said vacuum pump;

an integrated shaft having a first portion and a second portion, said first portion of said shaft extending into said vacuum pump, and said second portion of said integrated shaft extending into said fluid pump;

a vacuum pump rotor formed as part of said integrated shaft and disposed within said housing and used as part of said vacuum pump;

a first lobe formed as part of said vacuum pump rotor;

a second lobe formed as part of said vacuum pump rotor such that said first portion of said integrated shaft is connected to and extends away from said first lobe and said second lobe, and said second portion of said integrated shaft is connected to and extends away from said first lobe and said second lobe;

a vane pump rotor mounted on said second portion of said integrated shaft and located in said housing such that said vane pump rotor is a part of said fluid pump;

a first bearing disposed within said housing and mounted to said first portion of said integrated shaft;

a second bearing disposed within said housing and mounted to said second portion of said integrated shaft;

wherein said first bearing and said second bearing support said integrated shaft for rotation within said housing such that as said integrated shaft rotates, said vacuum pump rotor rotates to cause said vacuum pump to generate a vacuum, and said vane pump rotor rotates to cause said fluid pump to pump fluid;

a cavity formed as part of said inner pump housing, said vane pump rotor disposed within said cavity formed as part of said inner pump housing;

an eccentric ring pivotally disposed within said cavity formed as part of said inner pump housing such that said eccentric ring surrounds said vane pump rotor;

a plurality of slots formed as part of said vane pump rotor;

a plurality of vanes in sliding contact with an inner surface of said eccentric ring, each one of said plurality of vanes slidably disposed within a respective one of said plurality of slots;

an intake passage formed as part of said outer pump housing and in fluid communication with said cavity formed as part of said inner pump housing; and an output passage formed as part of said outer pump housing and in fluid communication with said cavity formed as part of said inner pump housing;

at least one expansion area in fluid communication with said intake passage, said at least one expansion area formed by at least two of said plurality of vanes, a portion of said vane pump rotor, and said eccentric ring;

at least one compression area in fluid communication with said output passage, said at least one compression area formed by at least two of said plurality of vanes, a portion of said vane pump rotor, and said eccentric ring;

wherein as said integrated shaft and said vane pump rotor rotate, said at least one expansion area increases in size, drawing fluid into said at least one expansion area from said intake passage, and said at least one compression area reduces in size, forcing fluid into said output passage;

a first bearing disposed in an aperture formed as part of said vacuum housing, said first bearing mounted to said first portion of said integrated shaft; and a first fluid delivery conduit formed as part of said vacuum housing, said intermediate housing, said inner pump housing, and said outer pump housing;

wherein said first fluid delivery conduit is in fluid communication with said output passage such that a portion of pressurized fluid in said output passage flows through said first fluid delivery conduit to provide lubrication to said first bearing.

22. A unified variable displacement pump, comprising:

a housing;

a fluid pump, a portion of said housing being part of said fluid pump;

a vacuum pump, a portion of said housing being part of said vacuum pump;

an integrated shaft having a first portion and a second portion, said first portion of said shaft extending into said vacuum pump, and said second portion of said integrated shaft extending into said fluid pump;

a vacuum pump rotor formed as part of said integrated shaft and disposed within said housing and used as part of said vacuum pump;

a first lobe formed as part of said vacuum pump rotor;

a second lobe formed as part of said vacuum pump rotor such that said first portion of said integrated shaft is connected to and extends away from said first lobe and said second lobe, and said second portion of said integrated shaft is connected to and extends away from said first lobe and said second lobe;

a vane pump rotor mounted on said second portion of said integrated shaft and located in said housing such that said vane pump rotor is a part of said fluid pump;

a first bearing disposed within said housing and mounted to said first portion of said integrated shaft;

a second bearing disposed within said housing and mounted to said second portion of said integrated shaft;

wherein said first bearing and said second bearing support said integrated shaft for rotation within said housing such that as said integrated shaft rotates, said vacuum pump rotor rotates to cause said vacuum pump to generate a vacuum, and said vane pump rotor rotates to cause said fluid pump to pump fluid;

a cavity formed as part of said inner pump housing, said vane pump rotor disposed within said cavity formed as part of said inner pump housing;

an eccentric ring pivotally disposed within said cavity formed as part of said inner pump housing such that said eccentric ring surrounds said vane pump rotor;

a plurality of slots formed as part of said vane pump rotor;

a plurality of vanes in sliding contact with an inner surface of said eccentric ring, each one of said plurality of vanes slidably disposed within a respective one of said plurality of slots;

an intake passage formed as part of said outer pump housing and in fluid communication with said cavity formed as part of said inner pump housing; and an output passage formed as part of said outer pump housing and in fluid communication with said cavity formed as part of said inner pump housing;

at least one expansion area in fluid communication with said intake passage, said at least one expansion area formed by at least two of said plurality of vanes, a portion of said vane pump rotor, and said eccentric ring;

at least one compression area in fluid communication with said output passage, said at least one compression area formed by at least two of said plurality of vanes, a portion of said vane pump rotor, and said eccentric ring;

wherein as said integrated shaft and said vane pump rotor rotate, said at least one expansion area increases in size, drawing fluid into said at least one expansion area from said intake passage, and said at least one compression area reduces in size, forcing fluid into said output passage;

a second bearing disposed in a recess formed as part of said outer pum housing, said second bearing mounted to said second portion of said integrated shaft; and a second fluid delivery conduit formed as part of said outer pump housing;

wherein said second fluid delivery conduit is in fluid communication with said output passage such that a portion of pressurized fluid in said output passage flow through said second fluid delivery conduit to provide lubrication to said second bearing.

* * * * *